US007787789B2

(12) United States Patent
Nakayama et al.

(10) Patent No.: US 7,787,789 B2
(45) Date of Patent: Aug. 31, 2010

(54) FIXING DEVICE FOR IMAGE FORMING APPARATUS

(75) Inventors: Hiroshi Nakayama, Mishima (JP); Yohei Doi, Mishima (JP); Tetsuo Kitamura, Mishima (JP); Osamu Takagi, Chofu (JP); Satoshi Kinouchi, Shinjuku-ku (JP); Yoshinori Tsueda, Fuji (JP); Kazuhiko Kikuchi, Yokohama (JP); Masanori Takai, Izunokuni (JP); Toyoyasu Kusaka, Izu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 350 days.

(21) Appl. No.: 11/942,086

(22) Filed: Nov. 19, 2007

(65) Prior Publication Data

US 2008/0118263 A1 May 22, 2008

Related U.S. Application Data

(60) Provisional application No. 60/866,957, filed on Nov. 22, 2006.

(51) Int. Cl.
*G03G 15/20* (2006.01)

(52) U.S. Cl. ..... 399/69

(58) Field of Classification Search ..... 399/67, 399/69, 88, 70
See application file for complete search history.

(56) References Cited

U.S. PATENT DOCUMENTS 6,900,419 B2 * 5/2005 Takagi et al. ..... 219/619
7,277,650 B2 * 10/2007 Ihara et al. ..... 399/67
7,327,964 B2 * 2/2008 Funabiki et al. ..... 399/45

* cited by examiner

*Primary Examiner*—David M Gray
*Assistant Examiner*—Gregory H Curran
(74) *Attorney, Agent, or Firm*—Turocy & Watson, LLP

(57) ABSTRACT

A fixing device according to an embodiment of the present invention includes a microcomputer that exclusively performs temperature control for the fixing device. The microcomputer periodically calculates electric power that can be supplied to the fixing device. The microcomputer detects the temperature of the fixing device and the temperature in a printer unit and feedback-controls electric power supplied to the fixing device.

22 Claims, 3 Drawing Sheets

FIXING DEVICE FOR IMAGE FORMING APPARATUS

CROSS REFERENCE TO RELATED APPLICATION

This invention is based upon and claims the benefit of priority from prior U.S. Patent Application 60/866,957 filed on Nov. 22, 2006, the entire contents of which are incorporated herein by reference.

BACKGROUND OF THE INVENTION

1. Field of the Invention

The present invention relates to a fixing device mounted on image forming apparatuses such as a copying machine, a printer, and a facsimile, and, more particularly to a fixing device for an image forming apparatus that quickly and highly accurately performs temperature control.

2. Description of the Background

In a fixing device of an induction heating system used in image forming apparatuses of an electrophotographic system such as a copying machine and a printer, in general, the surface temperature of a heat roller is detected and a result of the detection is fed back to an induction heating coil to perform temperature control for the fixing device. In the past, such temperature control for the fixing device is performed using, for example, a CPU that controls operations of a printer. On the other hand, when a heat capacity of the fixing device is small, the temperature of the fixing device instantaneously and widely fluctuates depending on a fixing condition and the like. Thus, when the temperature control for the fixing device is delayed, it is likely that fixing performance is adversely affected by the delay. Therefore, it is necessary to quickly perform feedback control for the fixing device.

However, when electric power supplied to the induction heating coil is feedback-controlled using the CPU to subject the fixing device to temperature control as in the past, depending on processing speed of the CPU, it is likely that the supplied electric power cannot be instantaneously controlled. Since the control is delayed, it is likely that a temperature ripple of the fixing device increases, resulting in overshoot of the fixing device. Further, it is likely that an optimum fixing temperature corresponding to an operation mode is not obtained and, in particular, temperature control in a high-speed image forming apparatus is difficult.

Therefore, as the fixing device of the induction heating system, there is a demand for development of a fixing device for an image forming apparatus that instantaneously feedback-controls the supply of electric power to an induction heating coil, maintains a stable fixing temperature even if a heat capacity of the fixing device is small, and obtains a high-quality fixing image.

SUMMARY OF THE INVENTION

According to an aspect of the present invention, there is provided a fixing device for an image forming apparatus that accurately and quickly feedback-controls the supply of electric power to an induction heating coil of the fixing device to thereby improve fixing performance of a high-speed image forming apparatus and obtain a high-quality image.

According to an embodiment of the present invention, a fixing device for an image forming apparatus includes a fixing member that nips and carries a recording medium in a predetermined direction with a first rotating member and a second rotating member and subjects the recording medium to fixing processing, heat generating means that are respectively supplied with electric power and causes the fixing member to generate heat, a temperature sensor that detects the temperature of the fixing member, and a microcomputer exclusive for temperature control that calculates electric power that can be supplied to the heat generating means and controls the supply of electric power to the heat generating means according to a detection result of the temperature sensor.

DETAILED DESCRIPTION OF THE INVENTION

An embodiment of the present invention will be hereinafter explained in detail with reference to the accompanying drawings.

Figure 1:
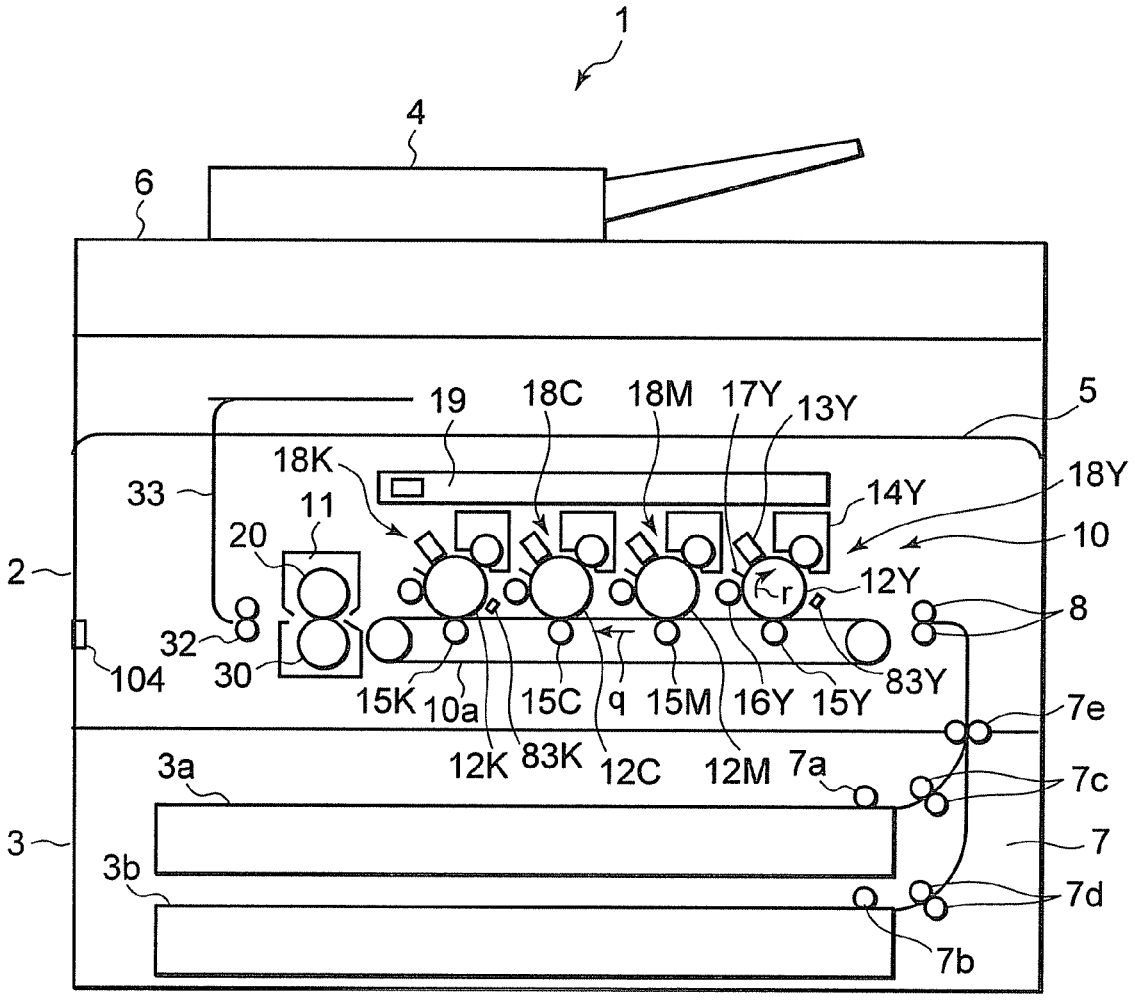
FIG. 1 is a schematic structural view showing an image forming apparatus according to an embodiment of the present invention.

FIG. 1 is a schematic structural view showing an image forming apparatus 1 according to the embodiment. The image forming apparatus 1 includes a scanner unit 6 that scans an original, a printer unit 2 that forms an image, and a paper feeding unit 3 that feeds sheet paper P as a recording medium. The scanner unit 6 converts image information scanned from an original supplied by a document feeder 4, which is provided on an upper surface thereof, into an analog signal.

A door switch 104 is provided on a front side of the printer unit 2. The door switch 104 is switched according to open and close of the front side of the printer unit 2. The printer unit 2 includes an image forming unit 10 in which image forming stations 18Y, 18M, 18C, and 18K for respective colors of yellow (Y), magenta (M), cyan (C), and black (K) are arranged in tandem along a transfer belt 10*a* rotated in an arrow "q" direction. The image forming unit 10 includes a laser exposure device 19 that irradiates laser beams corresponding to image information to photoconductive drums 12Y, 12M, 12C, and 12K of the image forming stations 18Y, 18M, 18C, and 18K for the respective colors. The printer unit 2 further includes a fixing device 11, a paper discharge roller 32, and a paper discharge and conveying path 33 that conveys the sheet paper P after fixing to a paper discharge unit 5.

In the image forming station 18Y for yellow (Y) of the image forming unit 10, a charging device 13Y, a developing device 14Y, a transfer roller 15Y, a cleaner 16Y, and a charge removing device 17Y are arranged around the photoconductive drum 12Y that rotates in an arrow "r" direction. The image forming stations 18M, 18C, and 18K for the respective colors of magenta (M), cyan (C), and black (K) have the structure same as that of the image forming station 18Y for yellow (Y). Apparatus body temperature sensors 83Y and 83K that detect the temperature in a main body of the image forming apparatus 1 are arranged around the image forming station 18Y for yellow (Y) and the image forming station 18K for black (K). In general, a photoconductive drum or a developing device tends to be affected by temperature or humidity. Thus, processing conditions for the image forming stations 18Y, 18M, 18C, and 18K for the respective colors are adjusted according to results of temperature detection by the apparatus body temperature sensors 83Y and 83K.

The paper feeding unit 3 includes first and second paper feeding cassettes 3*a* and 3*b*. In a conveying path 7 for the sheet paper P extending from the paper feeding cassettes 3*a* and 3*b* to the image forming unit 10, pickup rollers 7*a* and 7*b* that extract the sheet paper P from the sheet feeding cassettes 3*a* and 3*b*, separating and conveying rollers 7*c* and 7*d*, a conveying roller 7*e*, and a registration roller 8 are provided.

When print operation is started, in the image forming station 18Y for yellow (Y) of the printer unit 2, the photoconductive drum 12Y is rotated in the arrow "r" direction and uniformly charged by the charging device 13Y. Exposure light corresponding to yellow image information scanned by the scanner unit 6 is irradiated on the photoconductive drum 12Y by the laser exposure device 19 and an electrostatic latent image is formed thereon. Thereafter, a toner is supplied to the photoconductive drum 12Y by the developing device 14Y and a yellow (Y) toner image is formed thereon. In the position of the transfer roller 15, this yellow (Y) toner image is transferred onto the sheet paper P conveyed in the arrow "q" direction on the transfer belt 10*a*. After the transfer of the toner image is finished, a residual toner is removed from the photoconductive drum 12Y by the cleaner 16Y and electric charge on the surface of the photoconductive drum 12Y are removed by the charge removing device 17Y. In this way, the photoconductive drum 12Y is prepared for the next printing.

Toner images are formed in the image forming stations 18M, 18C, and 18K for the respective colors of magenta (M), cyan (C), and black (K) in the same manner as the image formation in the image forming station 18Y for yellow (Y). In the positions of the respective transfer rollers 15M, 15C, and 15K, the toner images of the respective colors formed in the image forming stations 18M, 18C, and 18K are sequentially transformed onto the sheet paper P on which the yellow toner image is formed. A color toner image is formed on the sheet paper P in this way. The sheet paper P is heated and pressed to have the color toner image fixed thereon by the fixing device 11 to complete a print image. Then, the sheet paper P is discharged to the paper discharging unit 5.

Figure 2:
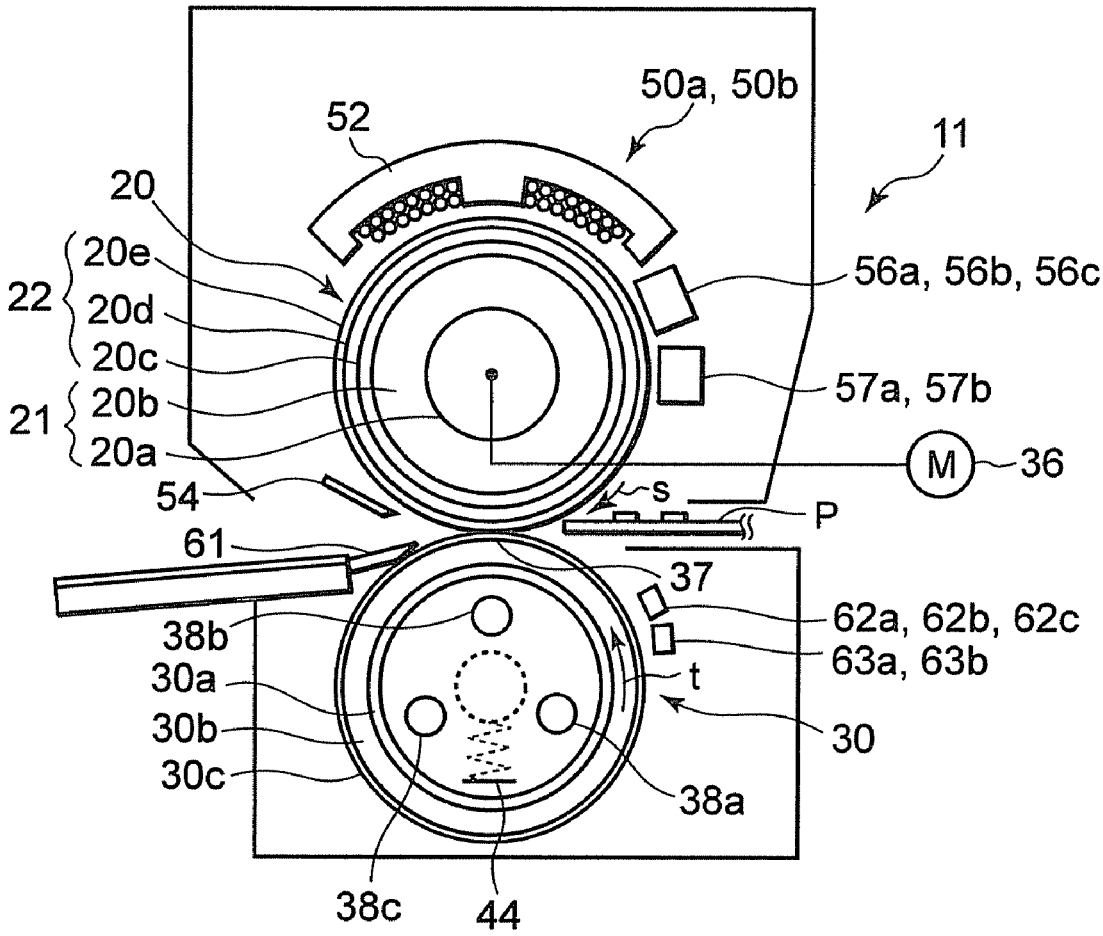
FIG. 2 is a schematic structural view of an fixing device according to the embodiment viewed from an axial direction thereof.

The fixing device 11 is explained. FIG. 2 is a schematic structural view of the fixing device 11 viewed from an axial direction thereof. The fixing device 11 includes a heat roller 20 as a first rotating member and a press roller 30 as a second rotating member. Diameters of the heat roller 20 and the press roller 30 are set to 40 mm. The heat roller 20 is rotated in an arrow "s" direction by a driving motor 36. The press roller 30 is pressed and brought into contact with the heat roller 20 by a pressing mechanism including a spring 44. Consequently, a nip 37 having a fixed width is formed between the heat roller 20 and the press roller 30. The press roller 30 is rotated in an arrow "t" direction following the heat roller 20.

The heat roller 20 includes, around a metal shaft 20*a*, foam rubber (sponge) 20*b* as an elastic body layer having the thickness of 5 mm, a metal layer 20*c* as a conductive layer made of nickel (Ni) having the thickness of 40 μm, a solid rubber layer 20*d* having the thickness of 200 μm, and a release layer 20*e* having the thickness of 30 μm. The metal layer 20*c* may be made of stainless steel, aluminum, a composite material of stainless steel and aluminum, or the like instead of nickel. The metal layer 20*c*, the solid rubber layer 20*d*, and the release layer 20*e* may be slidable with respect to the foam rubber (sponge) 20*b* instead of being integrated and bonded to the foam rubber (sponge) 20*b*.

The press roller 30 is constituted by covering, for example, the silicon rubber layer 30*b* and the release layer 30 *c* around the hollow metal shaft 30*a*. The layer thickness of the silicon rubber layer 30*b* of the press roller 30 is not limited. However, taking into account thermal conductivity at the time when heat generating means is provided in a hollow portion of the metal shaft 30*a*, it is desirable to set the layer thickness as thin as about 0.2 mm to 3 mm to realize a small temperature difference between an inner side and an outer side of the silicon rubber layer 30*b*.

On the outer circumference of the heat roller 20, a peeling pawl 54, first and second induction current generating coils 50*a* and 50*b* as heat generating means, first to third thermistors 56*a*, 56*b*, and 56*c* as temperature sensors, and first and second thermostats 57*a* and 57*b* are provided. The peeling pawl 54 prevents the sheet paper P after fixing from being twining around the heat roller 20. The peeling pawl 54 may be a contact type or a non-contact type. The first and second induction current generating coils 50*a* and 50*b* are provided on the outer circumference of the heat roller 20 via a predetermined gap and cause the metal layer 20*c* of the heat roller 20 to generate heat.

The first and third thermistors 56*a* and 56*c* detect the surface temperature on a side of the heat roller 20 in a non-contact manner and convert the surface temperature into a voltage. The second thermistor 56*b* detects the surface temperature substantially in the center of the heat roller 20 in a non-contact manner and converts the surface temperature into a voltage. As the first to third thermistors 56*a*, 56*b*, and 56*c* in non-contact with the heat roller 20, for example, infrared temperature sensors of a thermopile type are used. The first thermostat 57*a* detects trouble in the surface temperature on the side of the heat roller 20. The second thermostat 57*b* detects trouble in the surface temperature in the center of the heat roller 20. When the first or second thermostat 57*a* or 57*b* has detected trouble, the thermostat 57*a* or 57*b* forcibly turns off the supply of electric power to the first and second induction current generating coils 50*a* and 50*b* and first to third halogen lamps 38*a*, 38*b*, and 38*c* described later.

The first induction current generating coil 50*a* causes a center area of the heat roller 20 to generate heat. The second induction current generating coil 50*b* causes areas on both sides of the heat roller 20 to generate heat. The first and second induction current generating coils 50*a* and 50*b* output electric powers alternately. The electric powers are set to be adjustable, for example, between 200 W to 1500 W. The first and second induction current generating coils 50*a* and 50*b* may be capable of simultaneously outputting electric powers. When the first and second induction current generating coils 50*a* and 50*b* simultaneously output electric powers, the electric powers can be changed. For example, when the number of pieces of the sheet paper P that pass the center area of the heat roller 20 is large compared with that on both the sides, electric power outputted by the first induction current generating coil 50*a* can be set larger than electric power outputted by the second induction current generating coil 50*b*.

The first and second induction current generating coils 50*a* and 50*b* have a shape substantially coaxial with the heat roller 20 and are formed by winding a wire around a magnetic body core 52 for concentrating magnetic fluxes on the heat roller 20. As the wire, for example, a Litz wire formed by binding plural copper wires coated with heat resistant polyamide-imide and insulated from one another is used. By using the Litz wire as the wire, a diameter of the wire can be set smaller than the depth of penetration of a magnetic field. Consequently, it is possible to effectively feed a high-frequency current to the wire. In this embodiment, the Litz wire is formed by binding nineteen copper wires having a diameter of 0.5 mm.

When a predetermined high-frequency current is supplied to such a Litz wire, the first and second induction current generating coils 50*a* and 50*b* generate a magnetic flux. With this magnetic flux, the first and second induction current generating coils 50*a* and 50*b* generate an eddy-current in the metal layer 20*c* to prevent a magnetic field from changing. Joule heat is generated by this eddy-current and a resistance of the metal layer 20*c* and the heat roller 20 is instantaneously heated.

The press roller 30 includes, for example, first to third halogen lamps 38*a*, 38*b*, and 38*c* as heat generating means and heaters in the hollow metal shaft 30*a*. The first to third halogen lamps 38*a*, 38*b*, and 38*c* heat the entire length of a fixing area of the press roller 30 together. Power consumption of the first halogen lamp 38*a* is set to 300 W. Power consumption of the second halogen lamp 38*b* is set to 500 W. Power consumption of the third halogen lamp 38*c* is set to 1000 W. Infrared heaters may be used as the heaters.

On the outer circumference of the press roller 30, a peeling pawl 61, fourth to sixth thermistors 62*a*, 62*b*, and 62*c* as temperature sensors, and third and fourth thermostats 63*a* and 63*b* are provided along the rotating direction of the press roller 30.

The fourth and sixth thermistors 62*a* and 62*c* detect the surface temperature on a side of the press roller 30 and convert the surface temperature into a voltage. The fifth thermistor 62*b* detects the surface temperature in substantially the center of the press roller 30 and converts the surface temperature into a voltage. As the fourth to sixth thermistors, for example, infrared temperature sensors of a non-contact thermopile type are used. The third thermostat 63*a* detects trouble in the surface temperature on the side of the press roller 30. The fourth thermostat 63*b* detects trouble in the surface temperature in the center of the press roller 30. When the third or fourth thermostat 63*a* or 63*b* has detected trouble, the thermostat 63*a* or 63*b* forcibly turns off the supply of electric power to the first and second induction current generating coils 50*a* and 50*b* and the first to third halogen lamps 38*a*, 38*b*, and 38*c*.

Figure 3:
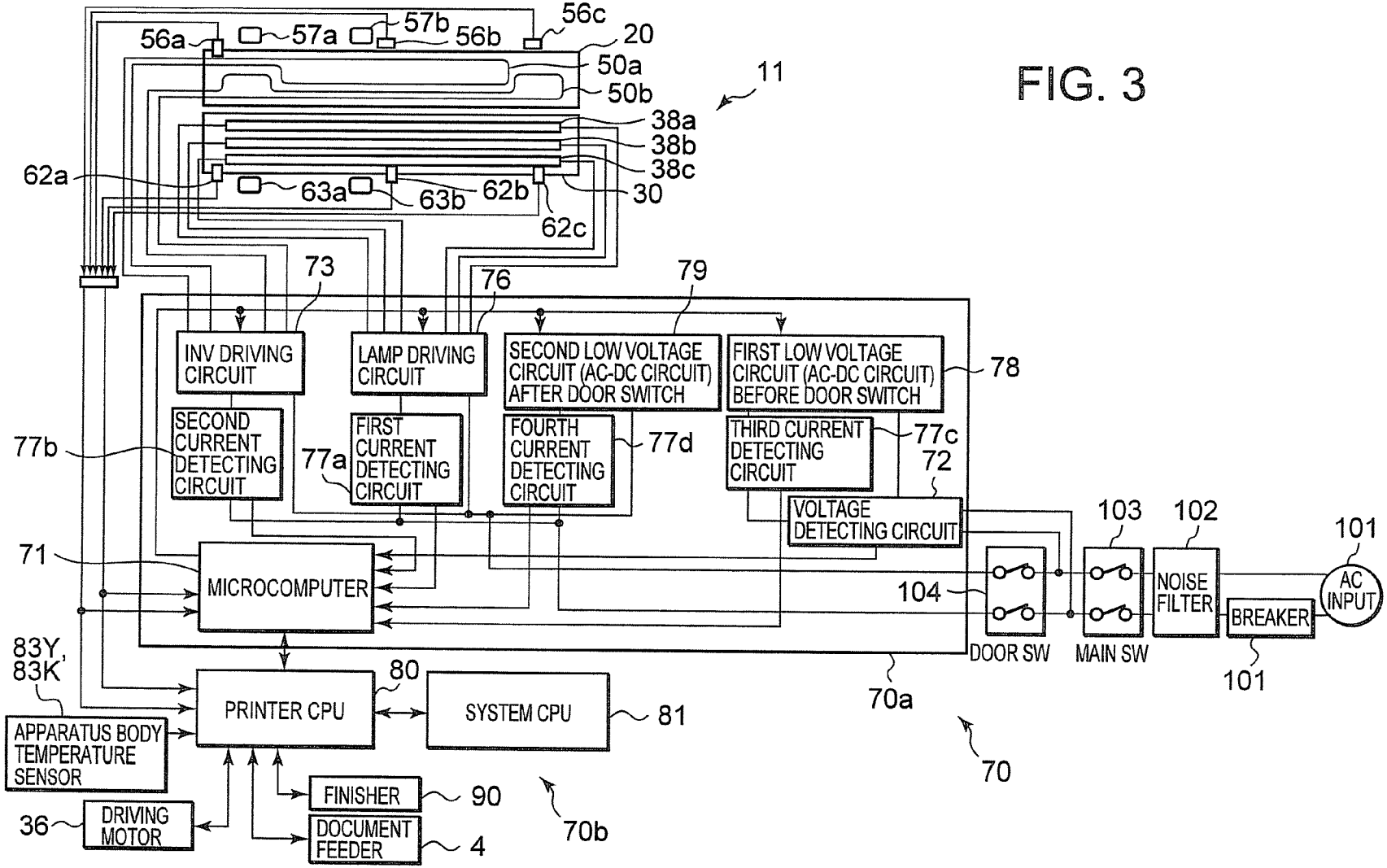
FIG. 3 is a schematic block diagram showing a control system of the fixing device according to the embodiment.

A control system 70 that controls the fixing device 11 is explained with reference to FIG. 3. The control system 70 includes, on a secondary side 70*b*, a printer CPU 80 that performs operation control for the printer unit 2, the paper feeding unit 3, the driving motor 36, options such as the document feeder 4 and a finisher 90, and the like. The printer CPU 80 on the secondary side 70*b* is controlled by a system CPU 81 that controls an entire system of the image forming apparatus 1. The temperature in the printer unit 2 is inputted to the printer CPU 80 from the apparatus body temperature sensors 83Y and 83K.

On the other hand, the control system 70 includes, on a primary side 70*a*, a microcomputer 71 as a microcomputer exclusive for temperature control. As the microcomputer 71, for example, a DSP (Digital Signal Processor) microcomputer having a sum-of-product operation processing function at high speed is used. However, the microcomputer 71 is not limited to this. On the primary side 70*a* of the control system 70, the microcomputer 71 controls an inverter driving circuit 73 that supplies driving power to the first and second induction current generating coils 50*a* and 50*b* and a lamp driving circuit 76 that supplies electric power to the first to third halogen lamps 38*a*, 38*b*, and 38*c*.

Moreover, on the primary side 70*a*, the control system 70 includes a first low voltage circuit 78, which is an AC-DC circuit, as a first switch power supply and a second low voltage circuit 79, which is an AC-DC circuit, as a second switch power supply. The first low voltage circuit 78 controls the supply of electric power to the system CPU 81 and the printer CPU 80 that are actuated by switching of a main switch 103 and to which electric power is supplied before the supply of electric power to the door switch 104 of the printer unit 2. The second low voltage circuit 79 controls the supply of electric power for operation control for the driving motor 36, the paper feeding unit 3, the options, and the like actuated by switching of the door switch 104.

Moreover, a voltage detecting circuit 72 is provided on the primary side 70*a* of the control system 70. The voltage detecting circuit 72 detects a voltage of electric power inputted to the main switch 103 from a commercial AC power supply 100 via a breaker 101 and a noise filter 102.

A first current detecting circuit 77*a* as a first current detector connected to the lamp driving circuit 76 detects input currents to the first to third halogen lamps 38*a*, 38*b*, and 38*c* and inputs the input currents to the microcomputer 71. A second current detecting circuit 77*b* as a second current detector connected to the inverter driving circuit 73 detects an input current to the inverter driving circuit 73, which drives the first and second induction current generating coils 50*a* and 50*b*, and inputs the input current to the microcomputer 71.

Results of the temperature detection by the first to third thermistors 56*a*, 56*b*, and 56*c* and the fourth to sixth thermistors 62*a*, 62*b*, and 62*c* are inputted to the microcomputer 71 and the printer CPU 80. A result of the temperature detection by the apparatus body temperature sensors 83Y and 83K is also inputted to the microcomputer 71 via the printer CPU 80.

A third current detecting circuit 77*c* as a third current detector connected to the first low voltage circuit 78 detects an input current to the first low voltage circuit 78 before current input to the door switch 104 and inputs the input current to the microcomputer 71. A fourth current detecting circuit 77*d* as a fourth current detector connected to the second low voltage circuit 79 detects an input current to the second low voltage circuit 79 after current input to the door switch 104 and inputs the input current to the microcomputer 71.

Consequently, the microcomputer 71 can detect an input current of the entire system of the image forming apparatus 1 by totaling the input currents inputted by the first to fourth current detecting circuits 77*a*, 77*b*, 77*c*, and 77*d*. The microcomputer 71 can calculate electric powers of the first to third halogen lamps 38*a*, 38*b*, and 38*c*, the inverter driving circuit 73, the first low voltage circuit 78, and the second low voltage circuit 79 from the input currents inputted by the first to fourth current detecting circuits 77*a*, 77*b*, 77*c*, and 77*d*.

Temperature control for the fixing device 11 by the microcomputer 71 is explained. The system CPU 81 controls the entire system of the image forming apparatus 1. Operation control for the paper feeding unit 3 and the options of the image forming apparatus 1, operation control for the driving motor 36 of the printer unit 2 other than fixing temperature control, and the like are controlled by the printer CPU 80 controlled by the system CPU 81. Temperature control for the fixing device 11 of the printer unit 2 is controlled by the microcomputer 71. The microcomputer 71 detects, for example, at a period of 10 ms to 100 ms, electric currents of the first to fourth current detecting circuits 77*a*, 77*b*, 77*c*, and 77*d*, calculates electric power that can be supplied to the fixing device 11, and controls the fixing device 11.

When the main switch 103 is turned on, the system CPU 81 instructs the printer unit 2 to start a warming-up mode and the warming-up mode is started in the fixing device 11. After the start of the warming-up mode, for example, when the surface temperature of the heat roller 20 reaches 160° C. and the surface temperature of the press roller 30 reaches 130° C., the fixing device 11 becomes in a standby mode. (However, when the image forming apparatus 1 is placed in, for example, a cold room judging from a detection result of the apparatus body temperature sensors 83Y and 83K, for example, the surface temperature of the heat roller 20 may be set to 165° C. and the surface temperature of the press roller 30 may be set to 135° C.). Therefore, according to the start of the warming-up mode, the microcomputer 71 controls the supply of electric power to the first and second induction current generating coils 50*a* and 50*b* and the first to third halogen lamps 38*a*, 38*b*, and 38*c* such that the fixing device 11 enters the standby mode in a shorter time.

During this warming-up, the microcomputer 71 observes electric currents of the third and fourth current detecting circuits 77*c* and 77*d* and calculates maximum power that can be supplied to the first and second induction current generating coils 50*a* and 50*b* and the first to third halogen lamps 38*a*, 38*b*, and 38*c* in electric power that can be used in the entire system of the image forming apparatus 1. For example, in the case in which electric power of 1500 W can be used as total electric power of the entire system of the image forming apparatus 1 from the commercial power supply 100, when the supply of electric power to the system CPU 81 is controlled to be 200 W by the first low voltage circuit 78, the third current detecting circuit 77*c* detects 2 A. When the supply of electric power to the driving motor 36 is controlled to 300 W by the second low voltage circuit 79, the fourth current detecting circuit 77*d* detects 3 A.

Therefore, during the warming-up mode, the microcomputer 71 calculates that the maximum electric power that can be supplied to the fixing device 11 is 1000 W. In this maximum electric power of 1000 W, for example, 700 W is alternately supplied to the first and second induction current generating coils 50*a* and 50*b* by the inverter driving circuit 73 and the remaining 300 W is supplied to the first halogen lamp 38*a* by the lamp driving circuit 76.

Thereafter, temperature detection results of the heat roller 20 and the press roller 30 are inputted to the microcomputer 71 from the first to third thermistors 56*a*, 56*b*, and 56*c* and the fourth to sixth thermistors 62*a*, 62*b*, and 62*c*. As a result, for example, when the temperature of the heat roller 20 has reached 160° C. but the temperature of the press roller 30 has not reached 130° C., the microcomputer 71 reduces the supply of electric power to the first and second induction current generating coils 50*a* and 50*b* and, on the other hand, switches electric power of the halogen lamps on the press roller 30 side to large electric power in a range of the calculated maximum electric power that can be supplied.

For example, the microcomputer 71 feedback-controls the inverter driving circuit 73 and the lamp driving circuit 76 to reduce the supply of electric power to the first and second induction current generating coils 50*a* and 50*b* to 0 and, on the other hand, turn off the first halogen lamp 38*a* and supply 1000 W to the third halogen lamp 38*c*.

Thereafter, when the temperature of the press roller 30 reaches 130° C. in a state in which the heat roller 20 maintains the temperature of 160° C., the fixing device 11 becomes in the standby mode. In the standby mode, the fixing device 11 maintains a fixing temperature that immediately enables printing (fixable temperature) and stands by for a print instruction from the printer CPU 80. During the standby mode, the microcomputer 71 feedback-controls, for example, at a predetermined period of 10 ms to 100 ms, the inverter driving circuit 73 and the lamp driving circuit 76 from current detection results of the first to fourth current detecting circuits 77*a*, 77*b*, 77*c*, and 77*d* and temperature detection results of the first to third thermistors 56*a*, 56*b*, and 56*c* and the fourth to sixth thermistors 62*a*, 62*b*, and 62*c* and maintains the fixing device 11 at the fixable temperature.

During this period, the temperature in the printer unit 2 is inputted to the microcomputer 71 from the apparatus body temperature sensors 83Y and 83K via the printer CPU 80. In the case in which the environmental temperature of the printer unit 2 is low when the main switch 103 is turned on, for example, the printer CPU 80 raises a fixing control temperature. Consequently, the microcomputer 71 performs temperature control for the fixing device 11 in accordance with the raised fixing control temperature.

By performing warming-up control for the fixing device 11 in the microcomputer 71 exclusive for temperature control, compared with the feedback control performed by using the CPU that performs operation control for the printer unit 2 in the past, a warming-up time is reduced. The microcomputer 71 is capable of calculating electric power that can actually be supplied to the fixing device 11 from current values of the third and fourth current detecting circuits 77*c* and 77*d* and quickly and properly controlling the temperature of the fixing device 11.

When print operation is instructed by the print CPU 80, the microcomputer 71 immediately subjects the fixing device 11 to temperature control in a print mode. The microcomputer 71 calculates, from current values of the third and fourth current detecting circuits 77*c* and 77*d*, maximum power that can be supplied to the fixing device 11 and controls the inverter driving circuit 73 and the lamp driving circuit 76 according to a size of the sheet paper P, a type of the sheet paper P (e.g., plain paper, thick paper, or thin paper), and the like.

For example, in the case of printing on plain paper, the microcomputer 71 maintains the surface temperature of the heat roller 20 at 160±10° C. and maintains the surface temperature of the press roller 30 at 130±15° C. Here, it is assumed that the system of the image forming apparatus 1 includes, for example, the finisher 90 having the power consumption of 100 W as an optional function. In this case, since the second low voltage circuit 79 controls the driving motor 36 having the power consumption of 300 W and the finisher 90 having the power consumption of 100 W, the fourth current detecting circuit 77*d* detects 4 A.

Therefore, the microcomputer 71 observes electric currents of the third current detecting circuit 77*c* and the fourth current detecting circuit 77*d* and calculates that maximum electric power that can be supplied to the fixing device 11 is 900 W. The microcomputer 71 optimally distributes electric power supplied to the first and second induction current generating coils 50*a* and 50*b* and the first to third halogen lamps 38*a*, 38*b*, and 38*c* in a range of the maximum electric power of 900 W.

Moreover, the microcomputer 71 controls, according to the sheet paper P, the distribution of electric power to the first and second induction current generating coils 50*a* and 50*b* and the first to third halogen lamps 38*a*, 38*b*, and 38*c*. For example, in the case of fixing on the sheet paper P of the JIS standard A4 size, the microcomputer 71 supplies 600 W to the first induction current generating coil 50*a* and on/off-controls the first halogen lamp 38*a* having the power consumption of 300 W. While printing is performed, the microcomputer 71 controls, according to temperature detection results of the first to third thermistors 56*a*, 56*b*, and 56*c* and the fourth to sixth thermistors 62*a*, 62*b*, and 62*c*, the inverter driving circuit 73 and the lamp driving circuit 76 such that the heat roller 20 and the press roller 30 maintain a fixing temperature stable.

For example, when the temperature on the press roller 30 side has fallen, the microcomputer 71 reduces the supply of electric power to the first induction current generating coil 50*a* and, on the other hand, switches electric power of the halogen lamps on the press roller 30 side to large electric power according to the calculated maximum electric power that can be supplied. For example, the microcomputer 71 on/off-controls the second halogen lamp 38*b* having the power consumption of 500 W instead of the first halogen lamp 38*a*. On the other hand, the microcomputer 71 supplies remaining electric power obtained by subtracting electric power supplied to the second halogen lamp 38*b* from the calculated maximum power, which can be supplied to the fixing device 11, to the first induction current generating coil 50*a*.

When a type of the sheet paper P is changed during the print mode, the microcomputer 71 immediately controls the inverter driving circuit 73 and the lamp driving circuit 76 according to the type of the sheet paper P. For example, when the sheet paper P is changed to plain paper of the JIS standard B4 size, the microcomputer 71 calculates electric power that can be supplied to the fixing device 11. And for example, the microcomputer 71 controls the lamp driving circuit 76 to ON/OFF-control the first halogen lamp 38*a*. On the other hand, the microcomputer 71 controls the inverter driving circuit 73 to alternately supply electric power of 600 W to the first and second induction current generating coils 50*a* and 50*b*. In this way, the microcomputer 71 calculates electric power that can be supplied to the fixing device 11. Moreover, the microcomputer 71 feedback-controls the inverter driving circuit 73 and the lamp driving circuit 76 on the basis of the temperature of the heat roller 20 and the temperature of the press roller 30 according to a type of the sheet paper P and maintains the heat roller 20 and the press roller 30 at the fixing temperature.

Even during such a print mode, by performing temperature control for the fixing device 11 in the microcomputer 71, an increase in speed of feedback control for the heat roller 20 and the press roller 30 is realized. The microcomputer 71 can observe, at a predetermined period, electric power actually supplied to the first and second low voltage circuits 78 and 79 and calculate maximum electric power that can be supplied to the fixing device 11. Therefore, the microcomputer 71 can quickly and properly control the fixing device 11, prevent a temperature ripple of the fixing device 11 caused by delay of control speed, and obtain satisfactory fixing performance.

Thereafter, when the print mode is finished, the image forming apparatus 1 becomes to a standby mode. When a predetermined time elapses in the standby mode, the image forming apparatus 1 becomes to a preheating mode. In this preheating mode, the heat roller 20 and the press roller 30 are maintained at a preheating temperature lower than the fixing temperature. In the preheating mode, when a print instruction is issued from the printer CPU 80, it is possible to raise the temperatures of the heat roller 20 and the press roller 30 to the fixing temperature that immediately enables printing. In the preheating mode, for example, the surface temperature of the heat roller 20 is maintained at 80° C. and the surface temperature of the press roller 30 is maintained at 50° C.

Therefore, the microcomputer 71 controls the inverter driving circuit 73 and the lamp driving circuit 76 such that the heat roller 20 and the press roller 30 maintain the preheating temperature. In other words, the microcomputer 71 controls, according to temperature detection results of the first to third thermistors 56*a*, 56*b*, and 56*c* and the fourth to sixth thermistors 62*a*, 62*b*, and 62*c*, the inverter driving circuit 73 and the lamp driving circuit 76 to, for example, alternately supply electric power of 200 W to the first and second induction current generating coils 50*a* and 50*b* and on/off-control the first halogen lamp 38*a*.

When a print instruction is issued during the preheating mode, the microcomputer 71 controls the inverter driving circuit 73 and the lamp driving circuit 76 to reset the fixing device 11 to the print mode at high speed. In other words, the microcomputer 71 calculates, from electric currents of the third and fourth current detecting circuits 77*c* and 77*d*, maximum electric power that can be supplied to the fixing device 11. The microcomputer 71 controls electric power to be optimally distributed to the first and second induction current generating coils 50*a* and 50*b* and the first to third halogen lamps 38*a*, 38*b*, and 38*c* while observing temperature detection results of the first to third thermistors 56*a*, 56*b*, and 56*c* and the fourth to sixth thermistors 62*a*, 62*b*, and 62*c* at a predetermined period. In this way, the microcomputer 71 resets the fixing device 11 to the standby mode at high speed when the heat roller 20 and the press roller 30 reach the fixable temperature and starts the fixing operation.

While the fixing device 11 is subjected to temperature control by the microcomputer 71 as described above, due to a deficiency of the microcomputer 71, it is likely that the control of the inverter driving circuit 73 or the lamp driving circuit 76 becomes impossible and the surface temperature of the heat roller 20 or the press roller 30 exceeds a threshold. In such a case, any one of the first to fourth thermostats 57*a*, 57*b*, 63*a*, and 63*b* detects the trouble and forcibly turns of the inverter driving circuit 73 and the lamp driving circuit 76.

In the fixing device 11 according to this embodiment, the microcomputer 71 that exclusively performs temperature control for the fixing device 11 is provided on the primary side 70*a* of the control system 70. The microcomputer 71 periodically calculates electric power that can be supplied to the fixing device 11 and quickly and properly feedback-controls the first and second induction current generating coils 50*a* and 50*b* and the first to third halogen lamps 38*a*, 38*b*, and 38*c* from detection of the temperature of the fixing device 11 or detection of the temperature in the printer unit 2. Therefore, compared with the temperature control for the fixing device 11 performed by using the CPU that controls the entire printer unit 2 in the past, an increase in control speed is realized and the fixing device 11 can be more accurately subjected to temperature control with more suitable electric power. As a result, it is possible to reduce a warm-up time of the fixing device 11, reduce a temperature ripple, and realize an increase in speed of fixing and improvement of fixing performance.

The present invention is not limited to the embodiment and various modifications of the present invention are possible without departing from the spirit of the present invention. For example, the structure of the fixing device is not limited. For example, the first rotating member or the second rotating member may be formed in a belt shape. Induction current generating coils may be used as all the heat generating means. An auxiliary power supply may be further used in order to supply electric power to the heat generating means.

What is claimed is:

1. A fixing device for an image forming apparatus comprising:

a fixing member configured to nip and convey a recording medium in a predetermined direction with a first rotating member and a second rotating member and configured to fix the recording medium;

a plurality of heat generating means that are respectively supplied with electric power and configured to cause the fixing member to generate heat;

a temperature sensor configured to detect a temperature of the fixing member;

a third current detector configured to detect an input current to a first switch power supply before current input to a door switch of the image forming apparatus; and a fourth current detector configured to detect an input current to a second switch power supply after current input to the door switch of the image forming apparatus, and a microcomputer configured to calculate an electric power that can be supplied to the heat generating means, from a detection result of the third current detector and a detection result of the fourth current detector, and to control a supply of electric power to the heat generating means according to a detection result of the temperature sensor.

2. A fixing device for an image forming apparatus according to claim 1, wherein the microcomputer is configured to calculate a maximum electric power that can be supplied to the generating means by subtracting a sum of the electric power, which is obtained by the calculation from the detection result of the third current detector and the detection result of the fourth current detector, from total electric power that can be used for the image forming apparatus.

3. A fixing device for an image forming apparatus according to claim 1, wherein each of the heat generating means has at least an induction current generating coil configured to cause a conductive layer of the fixing member to generate heat and has a heater.

4. A fixing device according to claim 3, for an image forming further comprising:

apparatus a first current detector configured to detect an input current to the heater; and a second current detector configured to detect an input current to an inverter driving circuit that drives the induction current generating coil, wherein the microcomputer configured to calculate an electric power supplied to the heat generating means from a detection result of the first current detector and a detection result of the second current detector.

5. A fixing device for an image forming apparatus according to claim 3, wherein the first rotating member is a heat roller that has the conductive layer, the induction current generating coil configured to cause the conductive layer to generate heat, and the heater configured to heat the second rotating member.

6. A fixing device for an image forming apparatus according to claim 5, wherein the heat roller is formed by covering a surface of an elastic body layer with the conductive layer, and the induction current generating coil is arranged around the heat roller.

7. A fixing device for an image forming apparatus according to claim 1, wherein the microcomputer configured to calculate, according to an operation mode of the image forming apparatus, an electric power that can be supplied to the heat generating means.

8. A fixing device for an image forming apparatus according to claim 1, wherein the microcomputer configured to calculate, according to a type of the recording medium, an electric power that can be supplied to the heat generating means.

9. A fixing device for an image forming apparatus according to claim 1, wherein the microcomputer configured to calculate, according to temperature in the image forming apparatus, an electric power that can be supplied to the heat generating means.

10. An image forming comprising:

an image forming unit;

a fixing member configured to nip and conveys a recording medium in a predetermined direction with a first rotating member and a second rotating member and configured to fix the recording medium;

a plurality of heat generating means that are respectively supplied with electric power and configured to cause the fixing member to generate heat;

a temperature sensor configured to detect a temperature of the fixing member;

a door switch configured to associate with open and close of a front of the image forming unit;

a third current detector configured to detect an input current to a first switch power supply before current input to the door switch;

a fourth current detector configured to detect an input current to a second switch power supply after current input to the door switch; and a microcomputer configured to calculate maximum electric power that can be supplied to the generating means by subtracting a sum of electric power, which is obtained by calculation from a detection result of the third current detector and a detection result of the fourth current detector, from total electric power that can be used for the image forming apparatus and to control a supply of electric power to the heat generating means according to a detection result of the temperature sensor.

11. An image forming apparatus according to claim 10, wherein each of the heat generating means has an induction current generating coil configured to cause a conductive layer of the fixing member to generate heat and has a heater, the image forming apparatus further includes:

a first current detector configured to detect an input current to the heater; and a second current detector configured to detect an input current to an inverter driving circuit that drives the induction current generating coil, wherein, the microcomputer configured to calculate an electric power supplied to the heat generating means from a detection result of the first current detector and a detection result of the second current detector.

12. An image forming apparatus according to claim 11, wherein the first rotating member is a heat roller formed by covering a surface of an elastic body layer with the conductive layer, the induction current generating coil is arranged around the heat roller and configured to cause the conductive layer to generate heat, and the heater configured to heat the second rotating member.

13. An image forming apparatus according to claim 10, wherein the microcomputer configured to calculate, according to an operation mode of the image forming unit and a type of the recording medium, an electric power that can be supplied to the heat generating means.

14. A fixing temperature control method for an image forming apparatus comprising:

causing, with a plurality of heat generating means, a fixing member configured to nip and convey a recording medium in a predetermined direction and configured to fix the recording medium;

detecting a temperature of the fixing member;

detecting an input current to a first switch power supply before current input to a door switch and an input current to a second switch power supply after current input to the door switch;

calculating an electric power that can be supplied to the heat generating means; and controlling, according to a detection result of the temperature of the fixing member, a supply of electric power to the heat generating means in a range of the calculated power that can be supplied.

15. A fixing temperature control method for an image forming apparatus according to claim 14, further comprising:

calculating a maximum electric power that can be supplied to the heat generating means by subtracting a sum of electric power, which is obtained by detecting the input current to a first switch power supply and the input current to a second switch power supply, from total electric power that can be used for the image forming apparatus.

16. A fixing temperature control method for an image forming apparatus according to claim 14, further comprising:

calculating an electric power supplied to the heat generating means.

17. A fixing temperature control method for an image forming apparatus according to claim 14, wherein the heat generating means has at least an induction current generating coil and at least a heater.

18. A fixing temperature control method for an image forming apparatus according to claim 14, wherein the fixing member includes a heat roller that has the conductive layer and a second rotating member that comes into press contact with the heat roller and forms a nip between the second rotating member and the heat roller, the induction current generating coil configured to cause the conductive layer of the heat roller to generate heat, and the heater configured to heat the second rotating member.

19. A fixing temperature control method for an image forming apparatus according to claim 18, wherein the heat roller is formed by covering a surface of an elastic body layer with the conductive layer, and the induction current generating coil is arranged around the heat roller.

20. A fixing temperature control method for an image forming apparatus according to claim 14, further comprising:

calculating, according to an operation mode of the image forming apparatus, an electric power that can be supplied to the heat generating means.

21. A fixing temperature control method for an image forming apparatus according to claim 14, further comprising:

calculating, according to a type of the recording medium, an electric power that can be supplied to the heat generating means.

22. A fixing temperature control method for an image forming apparatus according to microcomputer exclusive for 14, further comprising:

calculating, according to temperature in the image forming apparatus, an electric power that can be supplied to the heat generating means.

* * * * *